US012631195B1

(12) United States Patent
Woodruff et al.

(10) Patent No.: US 12,631,195 B1
(45) Date of Patent: May 19, 2026

(54) VENTILATION FAN

(71) Applicant: Broan-NuTone LLC, Hartford, WI (US)

(72) Inventors: Robert J. Woodruff, Hartford, WI (US); Anup Nikam, Hartford, WI (US)

(73) Assignee: Broan-NuTone LLC, Hartford, WI (US)

( * ) Notice: Subject to any disclaimer, the term of this patent is extended or adjusted under 35 U.S.C. 154(b) by 0 days.

(21) Appl. No.: 19/211,940

(22) Filed: May 19, 2025

(51) Int. Cl.
*F04D 29/42* (2006.01)
*F04D 17/08* (2006.01)
*F04D 29/28* (2006.01)

(52) U.S. Cl.
CPC ..... *F04D 29/4226* (2013.01); *F04D 17/08* (2013.01); *F04D 29/281* (2013.01)

(58) Field of Classification Search
CPC ..... F04D 29/4226; F04D 17/08; F04D 29/281
See application file for complete search history.

(56) References Cited

U.S. PATENT DOCUMENTS 882,477 A * 3/1908 Neumann ..... F04D 29/4226 415/204
6,802,699 B2 10/2004 Mikami et al.
7,311,494 B2 12/2007 Farag et al.
11,946,486 B2 4/2024 Loercher
2007/0212218 A1* 9/2007 Seki ..... F04D 29/4226 415/204
2016/0025109 A1* 1/2016 Katsumata ..... F04D 29/4213 415/206
2018/0187908 A1* 7/2018 Brendel ..... F04D 29/681
2018/0209440 A1* 7/2018 Kono ..... F04D 29/663

FOREIGN PATENT DOCUMENTS

CN 205639066 U 4/2016
CN 111536078 * 5/2020 ..... F04D 29/4226
CN 222391627 U 6/2024
JP 253095 A 10/1994
JP 2019090343 A 11/2017
JP 6873031 B2 12/2017
JP 7248723 B2 2/2021
KR 1339929 B1 9/2013

* cited by examiner

*Primary Examiner* — Aaron R Eastman
(74) *Attorney, Agent, or Firm* — Hansen Reynolds LLC

(57) ABSTRACT

A ventilation fan having a fan housing with at least one outer wall defining an interior space, the fan housing defining an inlet and an outlet. A scroll having an outer wall defines an interior space, an inlet opening into the interior space, and an outlet spaced apart from the inlet. The scroll interior space is configured to house a fan wheel having an axis of rotation and capable of moving air from the scroll inlet to the scroll outlet. The scroll outer wall has an inner peripheral wall extending about the axis of rotation at a constant radius and an outer peripheral wall extending about the axis of rotation at a growing radius according to an expansion angle.

19 Claims, 18 Drawing Sheets

VENTILATION FAN

BACKGROUND

The present disclosure relates, generally, to a ventilation fan. More specifically, the present disclosure relates to a fan scroll configured reduce open space between the fan scroll and the fan wheel resulting in reduced turbulence in the fan scroll and increased performance of the ventilation fan.

Additional features of the present disclosure will become apparent to those skilled in the art upon consideration of illustrative embodiments exemplifying certain modes of carrying out the disclosure as presently perceived.

SUMMARY

A ventilation fan comprises a fan housing having at least one outer wall defining an interior space, the fan housing defining an inlet and an outlet; a scroll having an outer wall defining an interior space, an inlet opening into the interior space, and an outlet spaced apart from the inlet, wherein the scroll interior space is configured to house a fan wheel having an axis of rotation and capable of moving air from the scroll inlet to the scroll outlet, the scroll outer wall comprising an inner peripheral wall extending about the axis of rotation at a constant radius; and an outer peripheral wall extending about the axis of rotation at a growing radius according to an expansion angle. The height of the inner peripheral wall can reduce about the axis of rotation according to an angle of descent. The scroll can further comprising a transition wall extending between the inner peripheral wall and the outer peripheral wall. The inner peripheral wall can be configured to be spaced a gap from the outer edge of the fan wheel. The outer edge of the fan wheel can define a diameter and the size of the gap can be between 1% and 15% of the fan wheel outer edge diameter. In some embodiments, the expansion angle can be between 1 degree and 15 degrees. In some embodiments, the expansion angle can be 6 degrees.

A scroll for a ventilation fan comprising an outer wall defining an interior space, an inlet opening into the interior space, and an outlet spaced apart from the inlet, wherein the scroll interior space is configured to house a fan wheel having an axis of rotation and capable of moving air from the scroll inlet to the scroll outlet, the scroll outer wall comprising an inner peripheral wall extending about the axis of rotation at a constant radius; and an outer peripheral wall extending about the axis of rotation at a growing radius according to an expansion angle. The height of the inner peripheral wall can reduce about the axis of rotation according to an angle of descent. The scroll can further comprise a transition wall extending between the inner peripheral wall and the outer peripheral wall. The inner peripheral wall can be configured to be spaced a gap from the outer edge of the fan wheel. The outer edge of the fan wheel can define a diameter and the size of the gap can be between 1% and 15% of the fan wheel outer edge diameter. In some embodiments, the expansion angle can be between 1 degree and 15 degrees. In some embodiments, the expansion angle can be 6 degrees.

A scroll for a ventilation fan comprising an outer wall defining an interior space, an inlet opening into the interior space, and an outlet spaced apart from the inlet; and a fan wheel within the scroll interior space and defining an axis of rotation; the scroll outer wall comprising an inner peripheral wall extending about the axis of rotation at a constant radius; and an outer peripheral wall extending about the axis of rotation at a growing radius according to an expansion angle. The height of the inner peripheral wall can reduce about the axis of rotation according to an angle of descent. The scroll can further comprise a transition wall extending between the inner peripheral wall and the outer peripheral wall. The inner peripheral wall can be configured to be spaced a gap from the outer edge of the fan wheel. The outer edge of the fan wheel can define a diameter and the size of the gap can be between 1% and 15% of the fan wheel outer edge diameter. The small gap can be between 0.25 inches and 0.5 inches. In some embodiments, the expansion angle can be between 1 degree and 15 degrees. In some embodiments, the expansion angle can be 6 degrees.

BRIEF DESCRIPTIONS OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

DETAILED DESCRIPTION

Figure 1A:
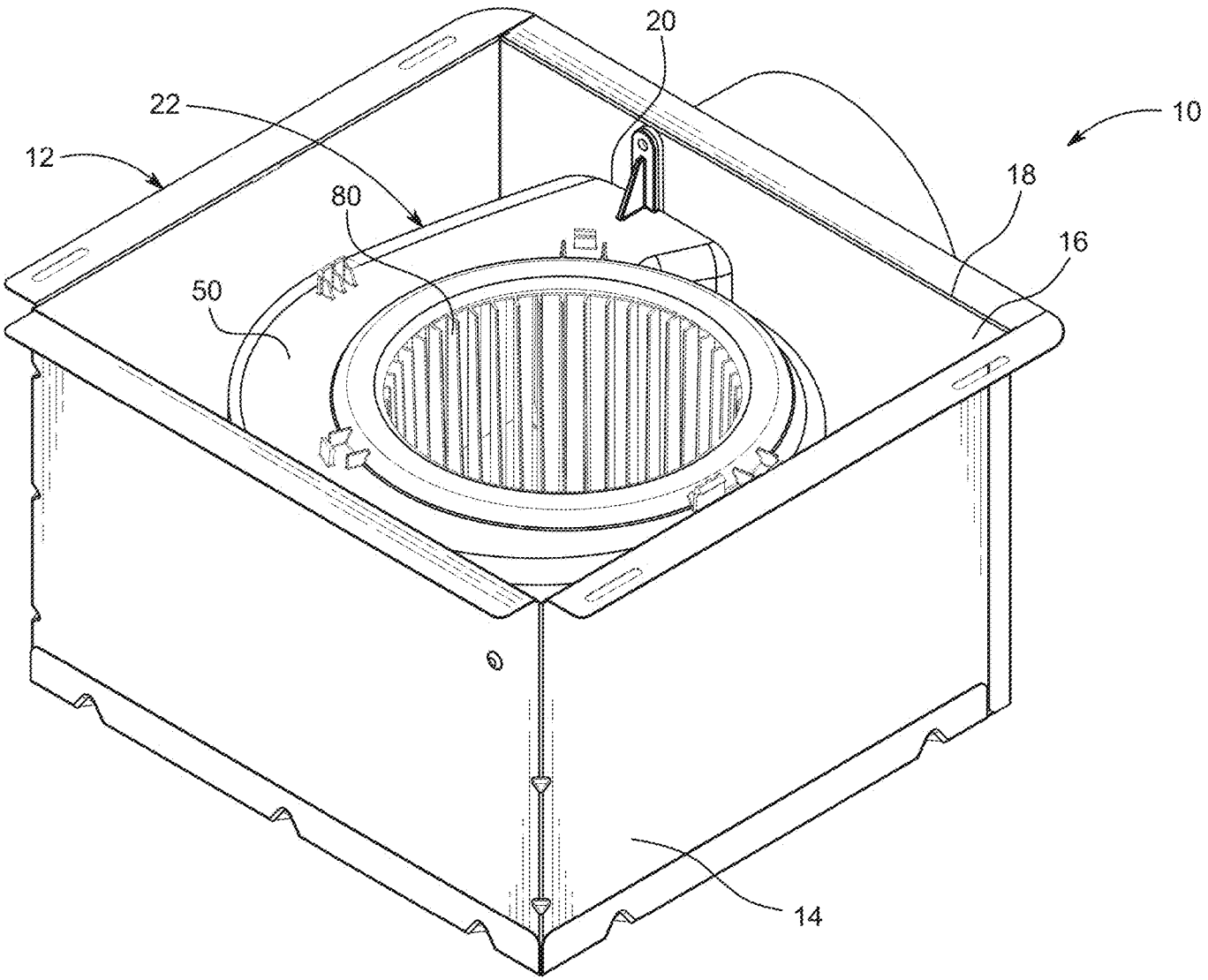
FIG. 1A is a top perspective view of a ventilation fan of this disclosure.
Figure 1B:
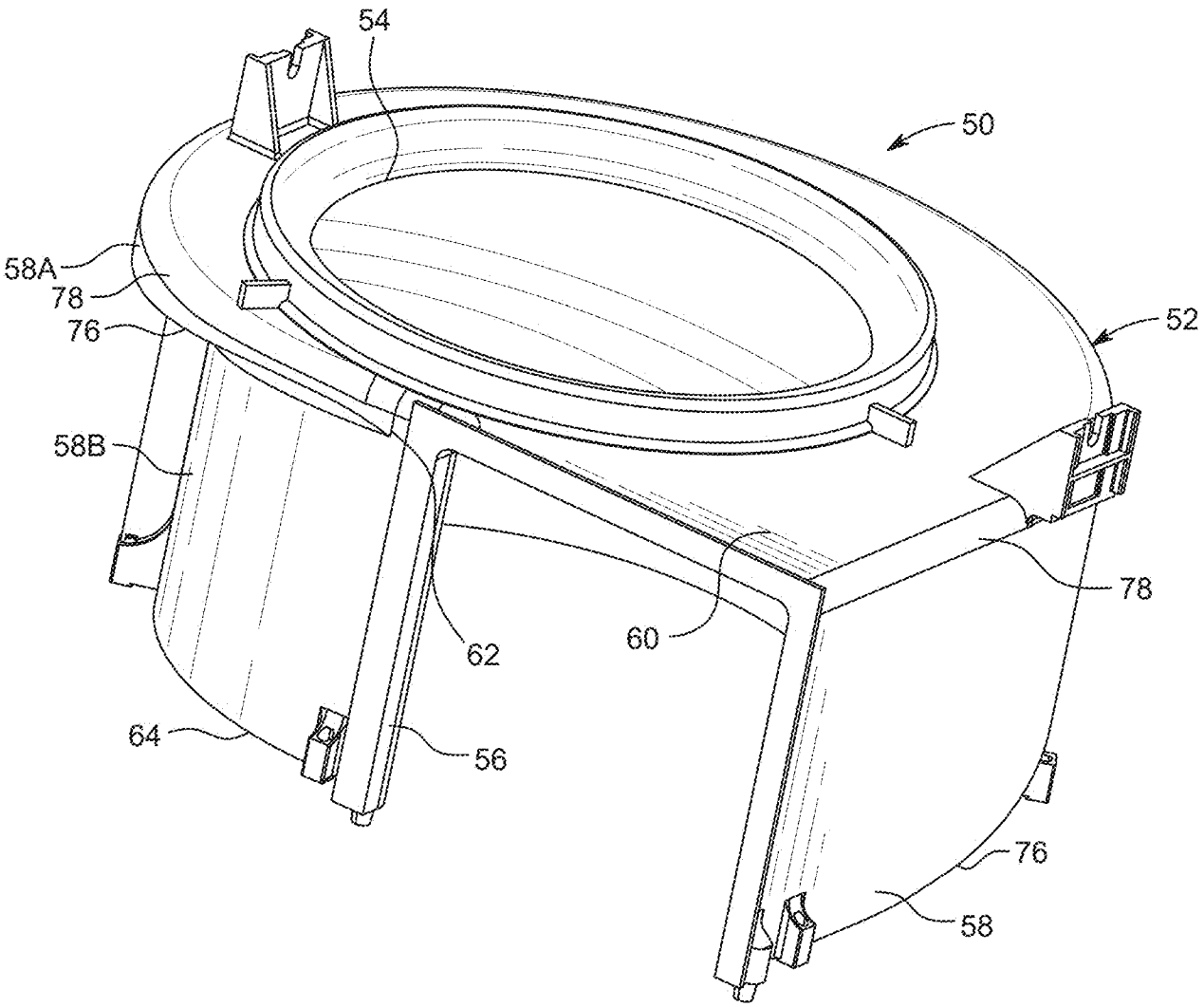
FIG. 1B is a top, front perspective view of a scroll of the ventilation fan of FIG. 1A.
Figure 1C:
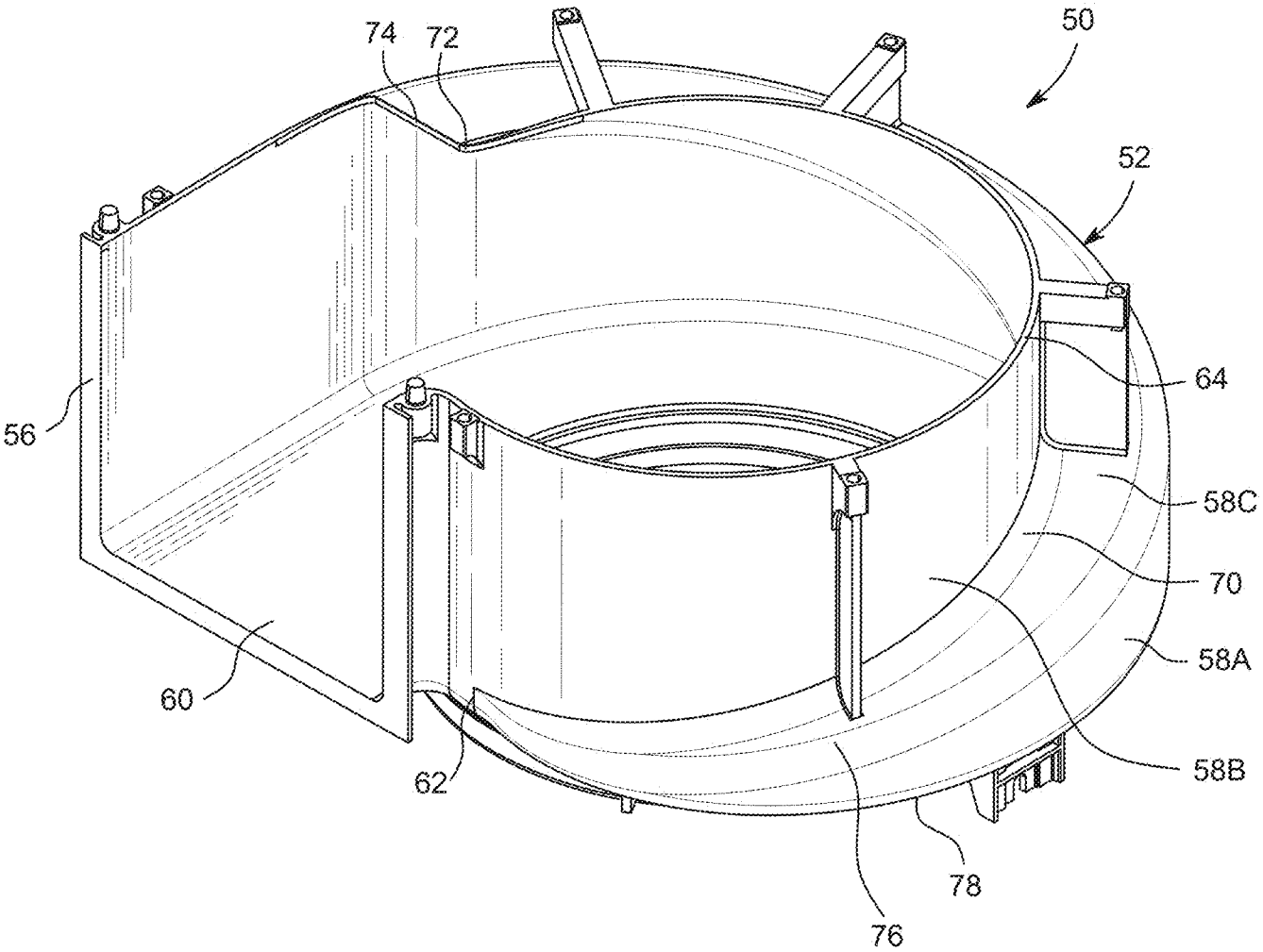
FIG. 1C is a bottom, front perspective view of the scroll of the ventilation fan of FIG. 1A.

FIG. 1A depicts one embodiment of a ventilation fan 10 in accordance with the present disclosure. The ventilation fan 10 is configured to be positioned in a room of a building structure (not depicted) to provide ventilation for the room of the building structure. For example, the ventilation fan 10 may be positioned in a ceiling panel or wall (not shown) of the room and aligned with a cutout in the ceiling or wall panel to selectively ventilate the room. The ventilation fan 10 has a fan housing 12 with an external wall structure 14 that defines an internal region 16. The external wall structure 14 defines an inlet 18 through which air can be drawn and an outlet 20 through which air can be expelled. A blower 22 is located in the internal region 16 of the fan housing 12 and operable to move air between the housing inlet 18 and the housing outlet 20.

The fan housing 12 can be formed of any material known to those skilled in the art capable of withstanding varying temperatures, namely to withstand any heat radiated and/or conducted from the blower 22 and/or other components while providing structural integrity to the ventilation fan 10. In some embodiments, the fan housing 12 is formed of sheet metal, but could instead be formed of a ceramic or a polymer having a relatively high melting temperature and/or glass transition temperature. The fan housing 12 can have any shape, including a box-like or cubical shape, a hemi-spherical shape, a spherical shape, a pyramidal shape, and the like. The fan housing 12 can form a base or frame for the ventilation fan 10, thereby providing points and areas of attachment for other components of the ventilation fan 10.

In the depicted embodiment, the blower 22 is a centrifugal fan having a motor (not depicted), a scroll 50 and a fan wheel 80 (sometimes referenced herein as "wheel"). The fan wheel 80 is depicted herein as a bladed rotor configured to be rotated about an axis of rotation 82 to move air through the scroll. However, other types of blower assemblies can be employed as desired.

The scroll 50 has an outer wall 52 that partially encases the fan wheel 80 and defines a scroll inlet 54, through which the blower 22 can draw air, and a scroll outlet 56 through which the blower 22 can exhaust air. In the depicted embodiments, the scroll outer wall 52 has a curved peripheral wall 58 that extends around the fan wheel 80 and defines the scroll outlet 56. A top wall 60 extends across the top of the peripheral wall 58 and defines the scroll inlet 54. The top wall 60 is depicted as flat, but other configurations are also contemplated. The depicted embodiment shows the outer wall 52 leaving a bottom 64 of the scroll open at a lower end of the peripheral wall 58. The scroll bottom 64 may be closed by a scroll mounting plate (not shown). In other embodiments (not shown), a scroll bottom wall (not shown) extends across the scroll bottom 64 of the peripheral wall 58 and closes the scroll bottom 64.

The scroll peripheral wall 58 is comprised of an outer peripheral wall 58A and an inner peripheral wall 58B. The outer peripheral wall 58A extends downward from the scroll top wall 60 a portion of the height (as measured along the axis of rotation 82) of the peripheral wall 58 to a transition wall 58C. The outer peripheral wall 58A extends approximately parallel to the axis of rotation 82. The transition wall 58C has an outer edge 58C' extending from the outer peripheral wall 58A inward approximately perpendicular to the axis of rotation 82 to an inner edge 58C". The inner peripheral wall 58B extends downward from the transition wall inner edge 58C" to the scroll bottom 64. The inner peripheral wall 58B extends approximately parallel to the axis of rotation 82.

At a coincident point 62 adjacent to the scroll outlet 56, the outer peripheral wall 58A and the inner peripheral wall 58B are coincident and both extend approximately vertically at the same distance from the axis of rotation 82. The outer wall 58 is therefore straight and approximately parallel to the axis of rotation at the coincident point 62 and the transition wall 58C is not present.

From the coincident point 62, the inner peripheral wall 58B extends around the perimeter of the fan wheel 80 defining a gap G between the inner peripheral wall 58B and an outer edge 84 of the fan wheel 80. In some embodiments, the gap G is constant at all points between the inner peripheral wall 58B and the fan wheel outer edge. In some embodiments, the fan wheel outer edge 84 is circular having an approximately constant radius about the axis of rotation 82 and the inner peripheral wall 58B also has an approximately constant radius about the axis of rotation 82. In the depicted embodiment, the inner peripheral wall 58B extends from the bottom 64 of the scroll 50 to an inner peripheral wall upper edge 70.

In the depicted embodiment, the inner peripheral wall upper edge 70 defines a helix as it progresses around the outer peripheral wall 58, and about the axis of rotation 82, from the coincident point 62, angled downward toward the scroll bottom 64 and increasingly approaching the scroll bottom 64 as the inner peripheral wall 58B progresses around the axis of rotation 82 and gets farther from the coincident point 62. Eventually, the inner peripheral wall upper edge 70 reaches the scroll bottom 64 and the inner peripheral wall 58B terminates at a terminal end 72. The helix angle determines the rotational angle about the axis of rotation 82 from the coincident point 62 at which the inner peripheral wall 58B terminates.

At the coincident point 62, the transition wall 58C does not exist. However, as the peripheral wall 58 extends about the axis of rotation 82 from the coincident point 62, the transition wall 58C emerges from the upper end 70 of the inner peripheral wall 58B and extends outward perpendicular to the axis of rotation 82 (but other angles are also contemplated). The transition wall 58C extends from the transition wall inner edge 58C", at the inner peripheral wall upper edge 70, to the transition wall outer edge edge 58C' to define a width W.

The transition wall 58C follows the helical descent of the inner peripheral wall upper edge 70 from the coincident point 62 to the terminal end 72 of the inner peripheral wall where the transition wall 58C also defines a terminal end 74. In some embodiments, the helical descent (i.e. the downward angle of the helix) is a constant angle. In other embodiments, the angle can vary along the descent. In one preferred embodiment, the angle of descent is a constant 13 degrees.

As the transition wall 58C declines along the angle of descent, the transition wall width W increases, preferably, but not necessarily, at a constant rate to define what is known to those skilled in the art as an expansion angle. Therefore, as the transition wall 58C extends away front the coincident point 62 and about the upper edge 70 of the inner peripheral wall, the transition wall 58C both declines along the helix angle of descent and grows wider at the expansion angle. In some embodiments, the expansion angle can be between 1 degree and 15 degrees. In some embodiments, the expansion angle can be 6 degrees.

As the transition wall 58C emerges adjacent to the coincident point 62, so does the outer peripheral wall 58A. The outer peripheral wall 58A extends from an outer peripheral wall lower end 76, located at the transition wall outer edge 58C', upward to an outer peripheral wall upper end 78. In some embodiments, the outer peripheral wall 58A extends upward parallel to the axis of rotation 82, but other angles are also contemplated. The peripheral wall lower end 76 follows the helical descent of the transition wall 58C. In the depicted embodiment, the peripheral wall upper end 78 follows the flat shape of the scroll top wall 60. However, if the scroll top wall 60 were to vary, then the peripheral wall top end 78 would vary accordingly.

Figure 2A:
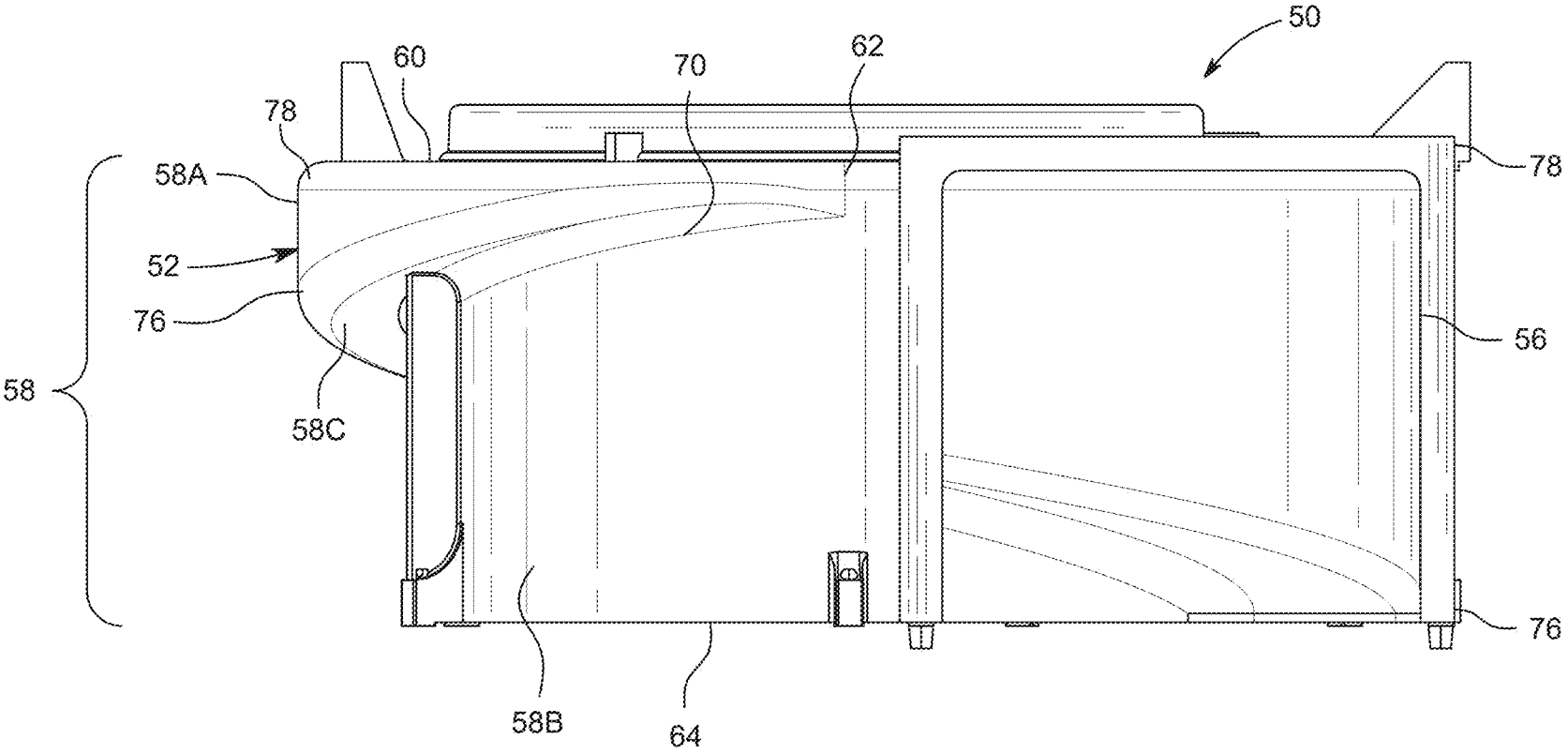
FIG. 2A is a front plan view of the scroll of FIG. 1B.
Figure 2B:
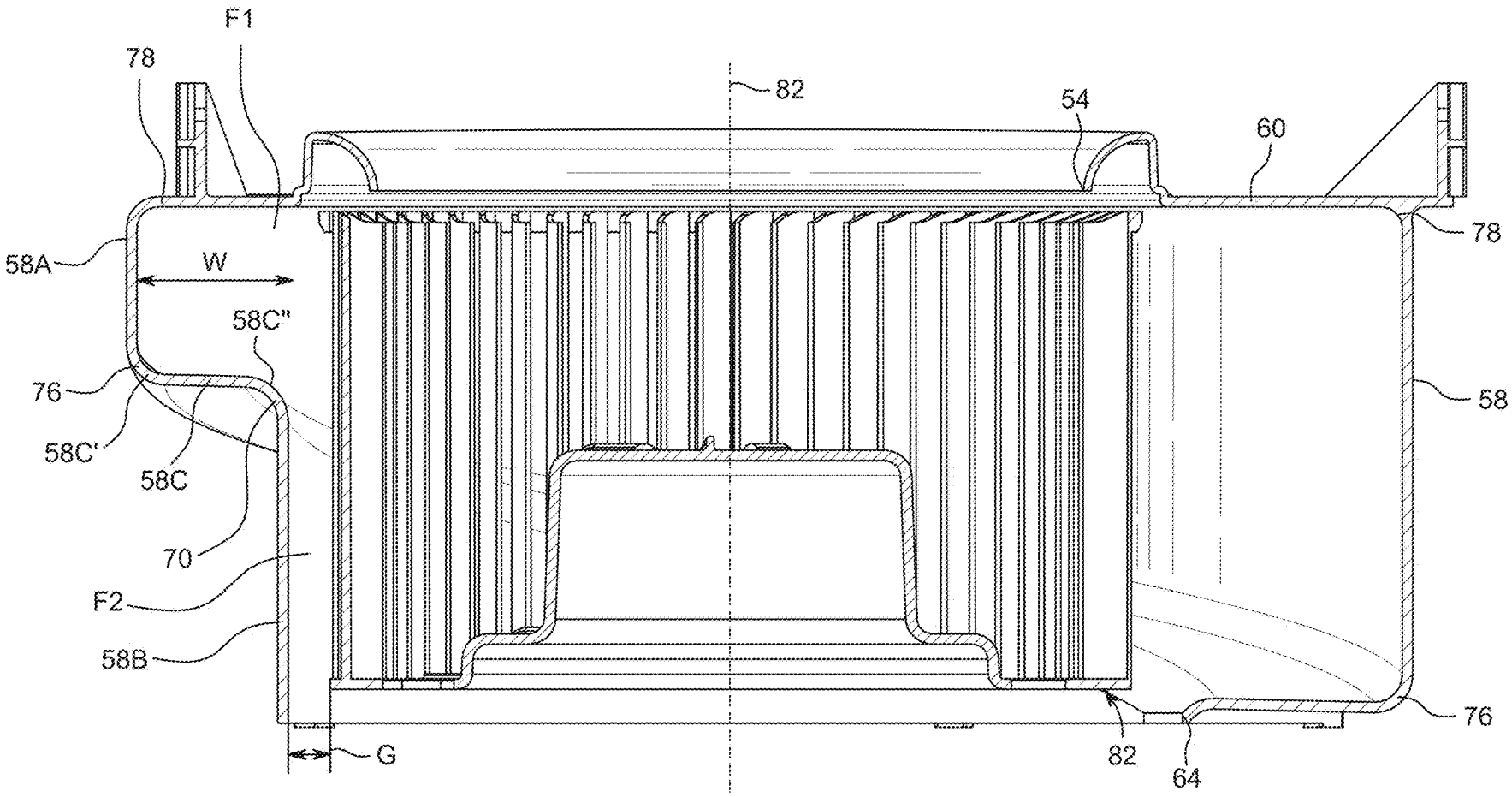
FIG. 2B is a vertical cross-section of the scroll as depicted in FIG. 2A with a fan wheel.
Figure 2C:
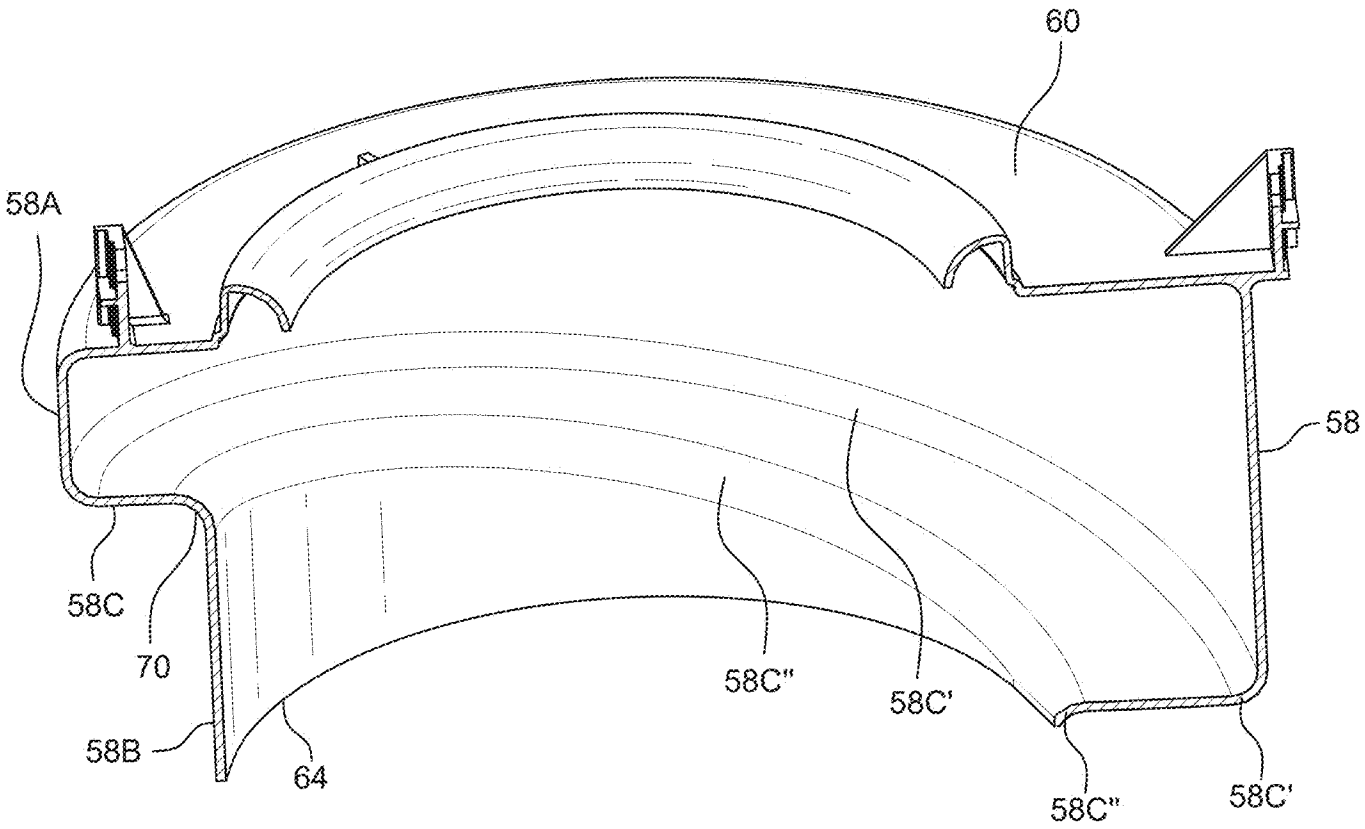
FIG. 2C is a top perspective view of the vertical cross-section depicted in FIG. 2B without the fan wheel.
Figure 3A:
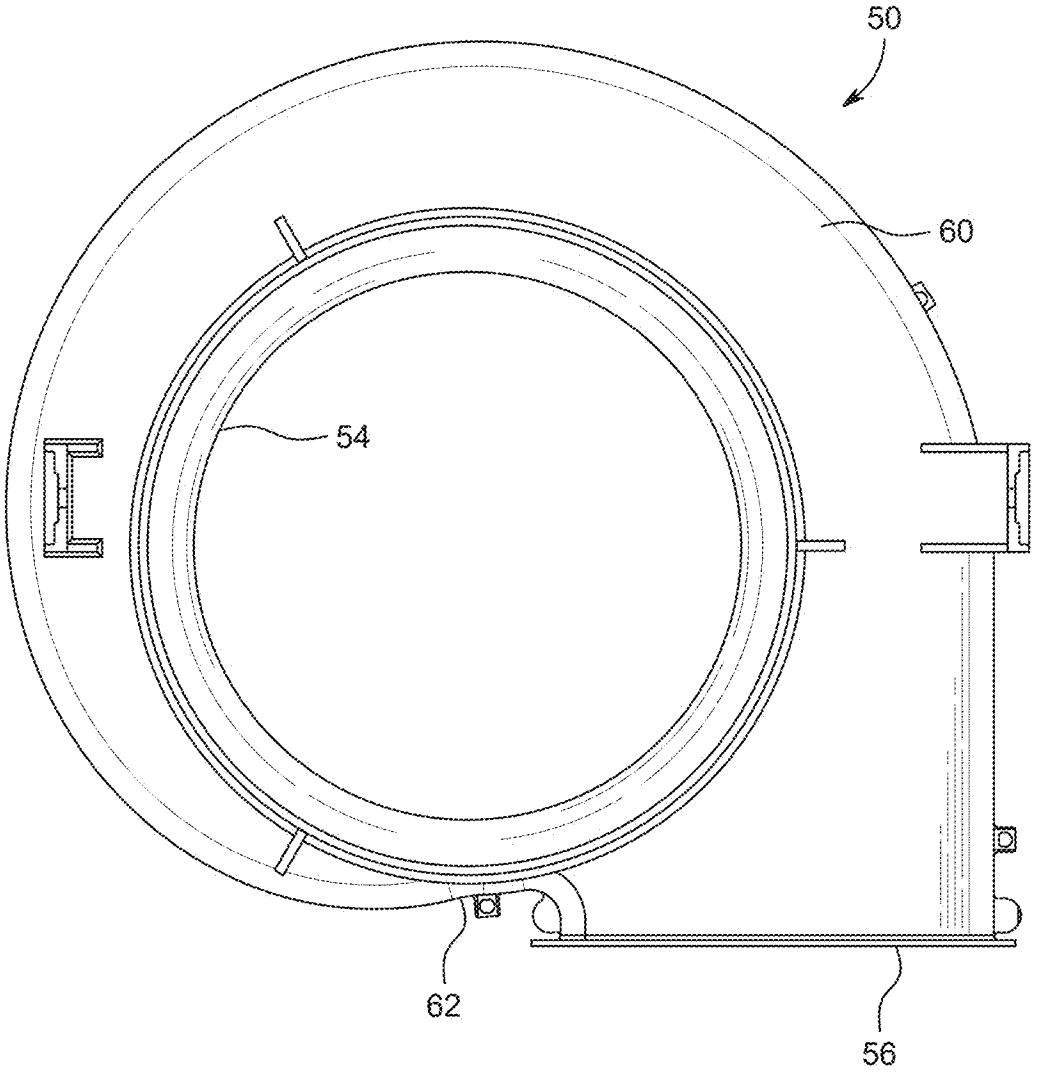
FIG. 3A is a top plan view of the scroll of FIG. 1B.
Figure 3B:
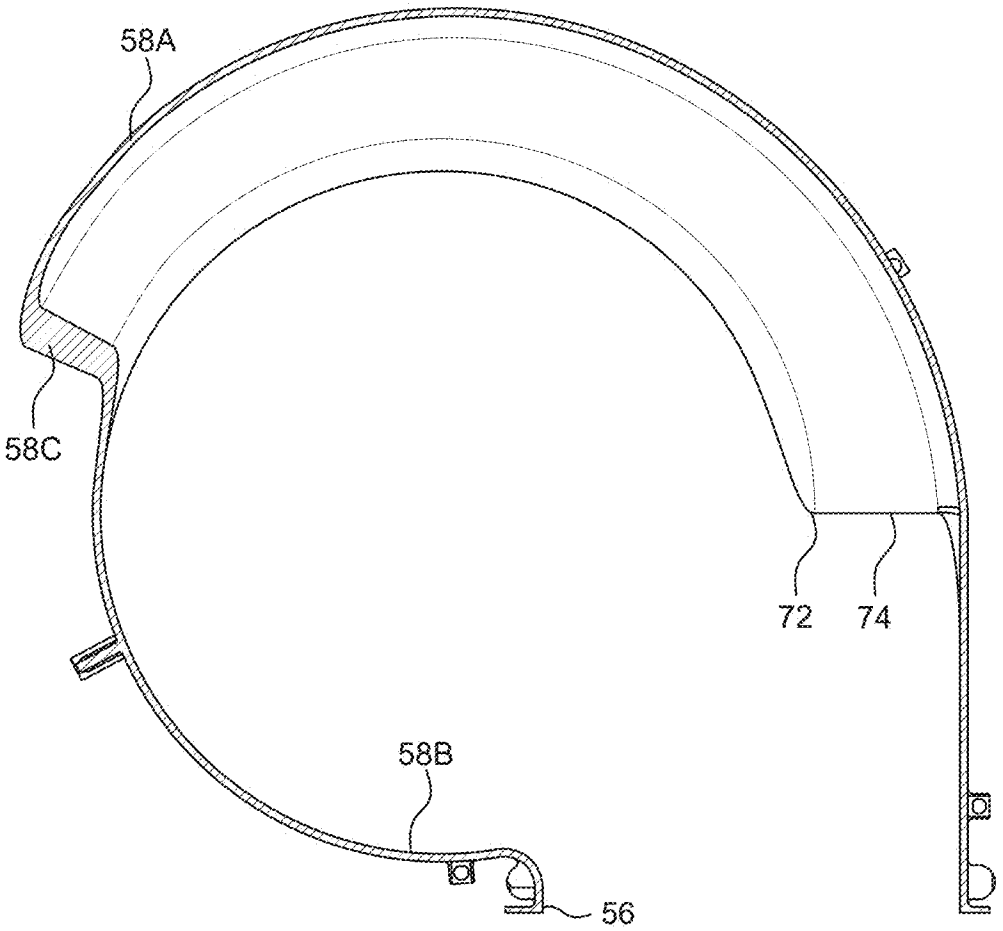
FIG. 3B is a horizontal cross-section of the scroll as depicted in FIG. 3A.
Figure 3C:
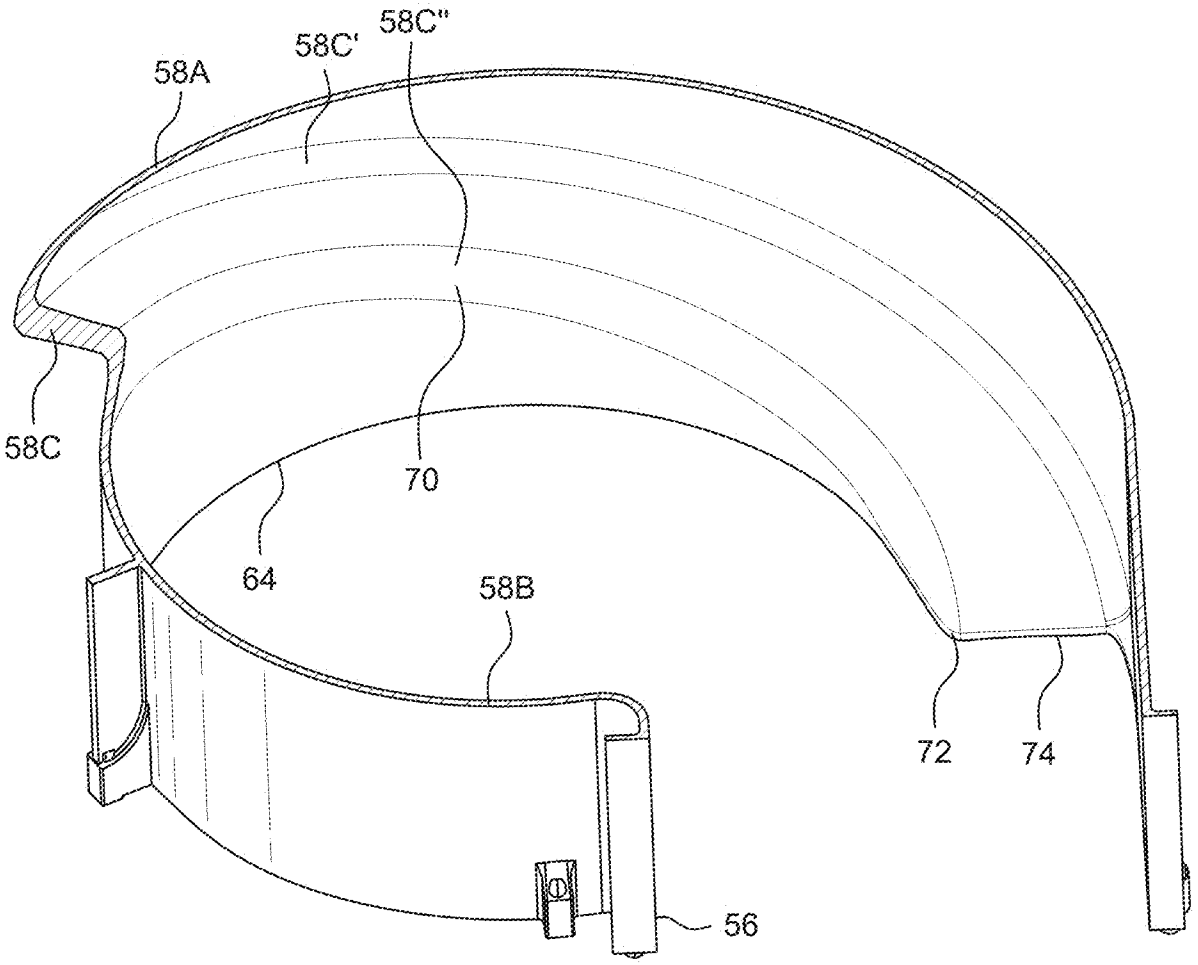
FIG. 3C is a top perspective view of the horizontal cross-section depicted in FIG. 3B.
Figure 4A:
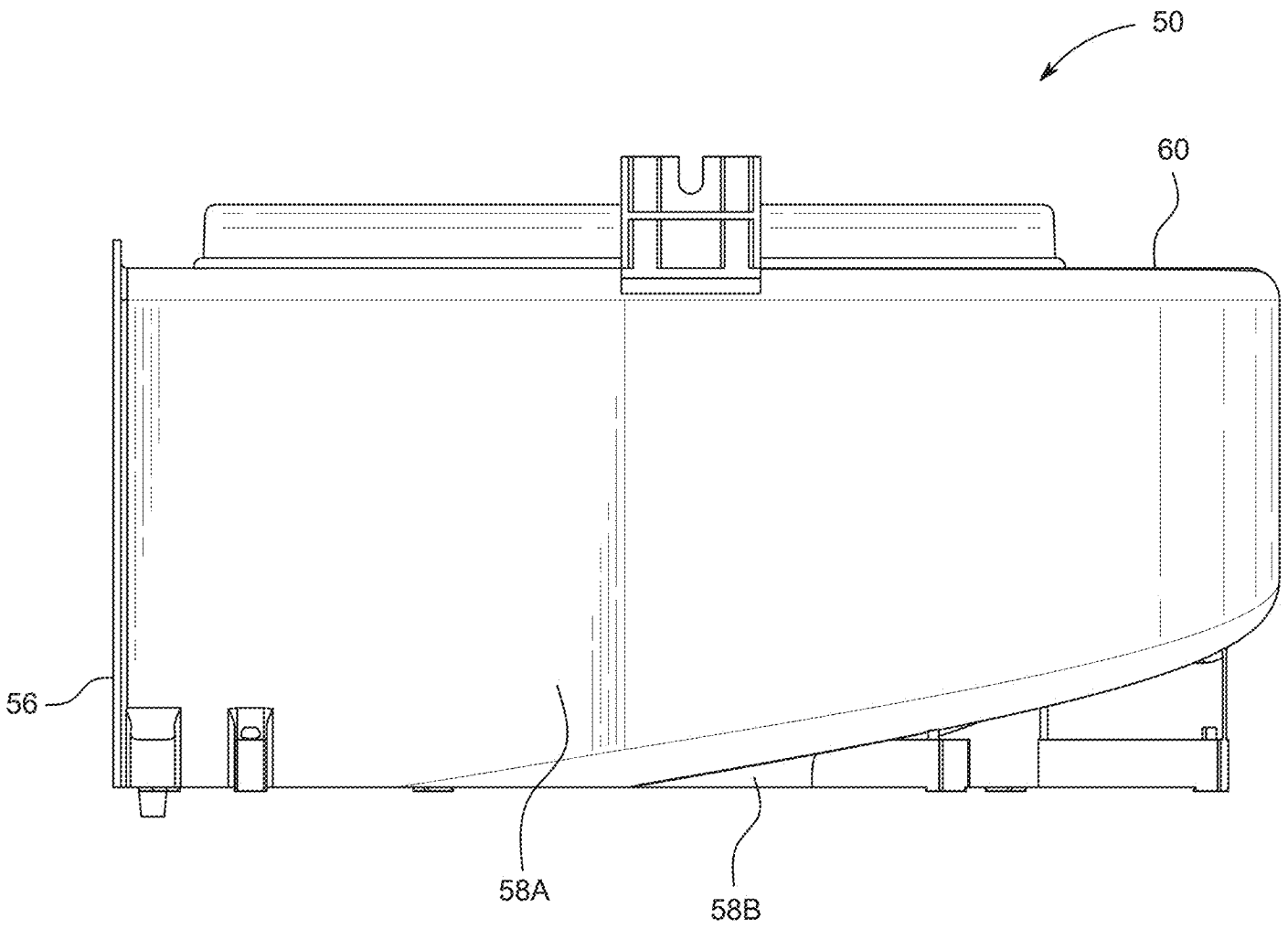
FIG. 4A is a right-side plan view of the scroll of FIG. 1B.
Figure 4B:
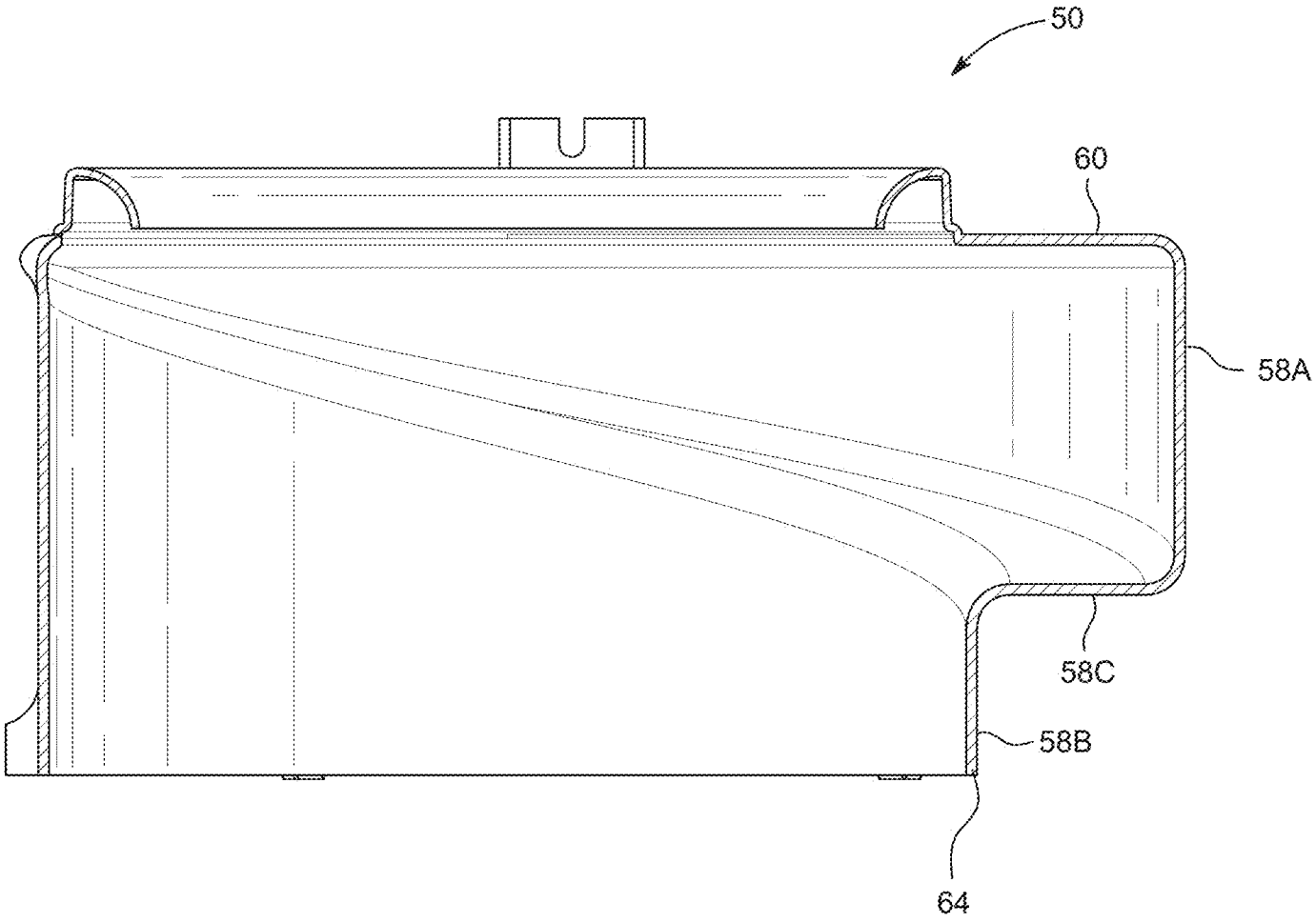
FIG. 4B is a vertical cross-section of the scroll as depicted in FIG. 4A.
Figure 4C:
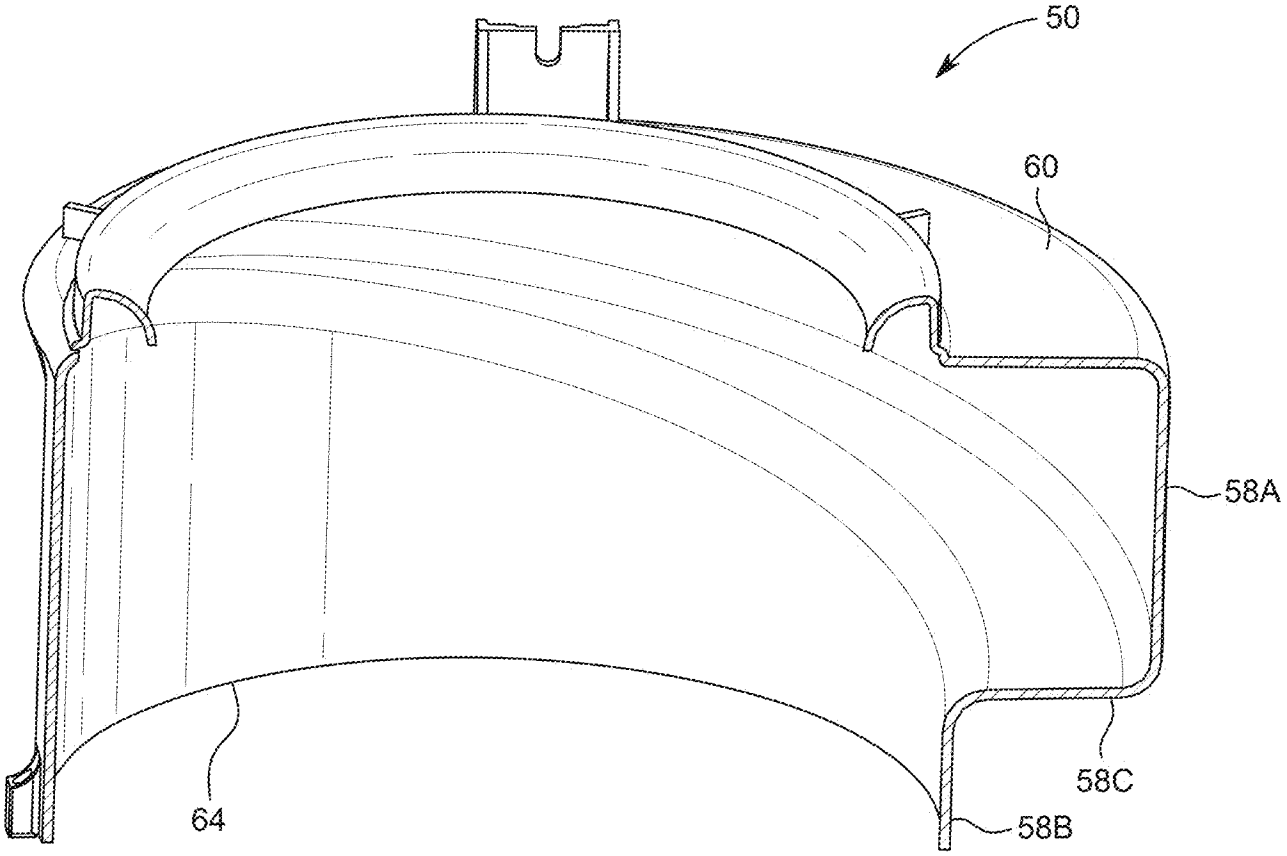
FIG. 4C is a top perspective view of the vertical cross-section depicted in FIG. 4B.
Figure 5A:
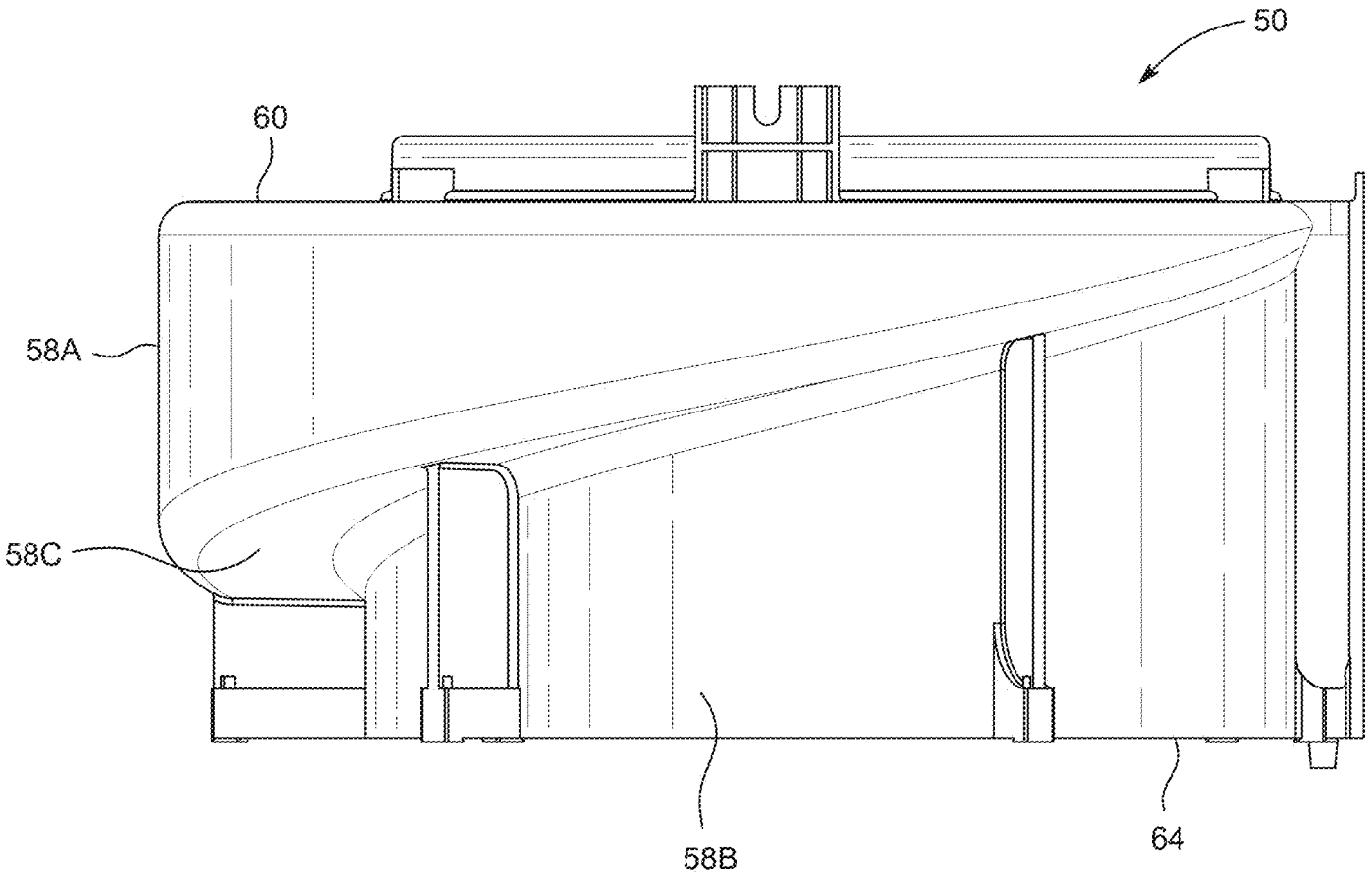
FIG. 5A is a left-side plan view of the scroll of FIG. 1B.
Figure 5B:
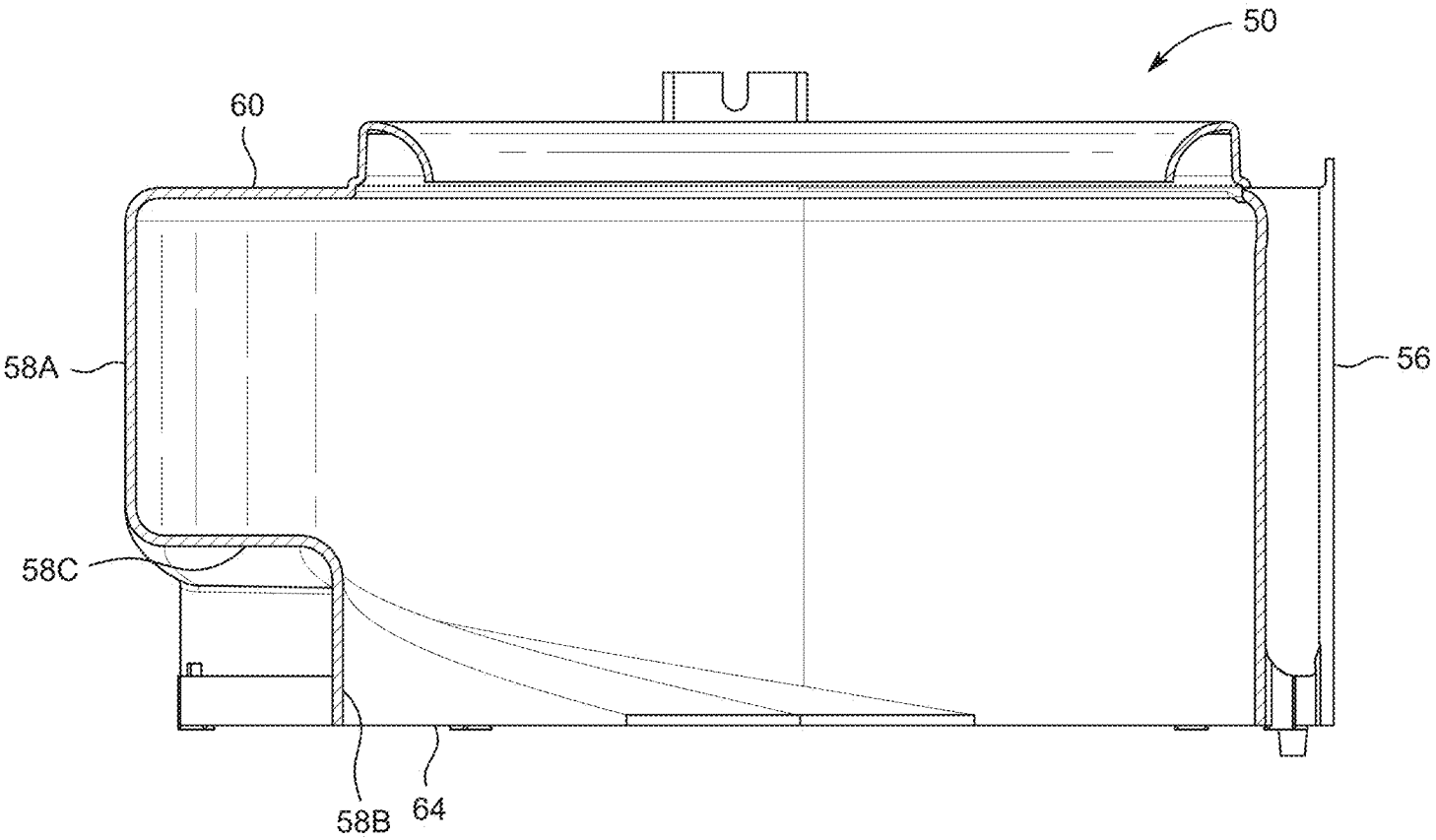
FIG. 5B is a vertical cross-section of the scroll as depicted in FIG. 5A.
Figure 5C:
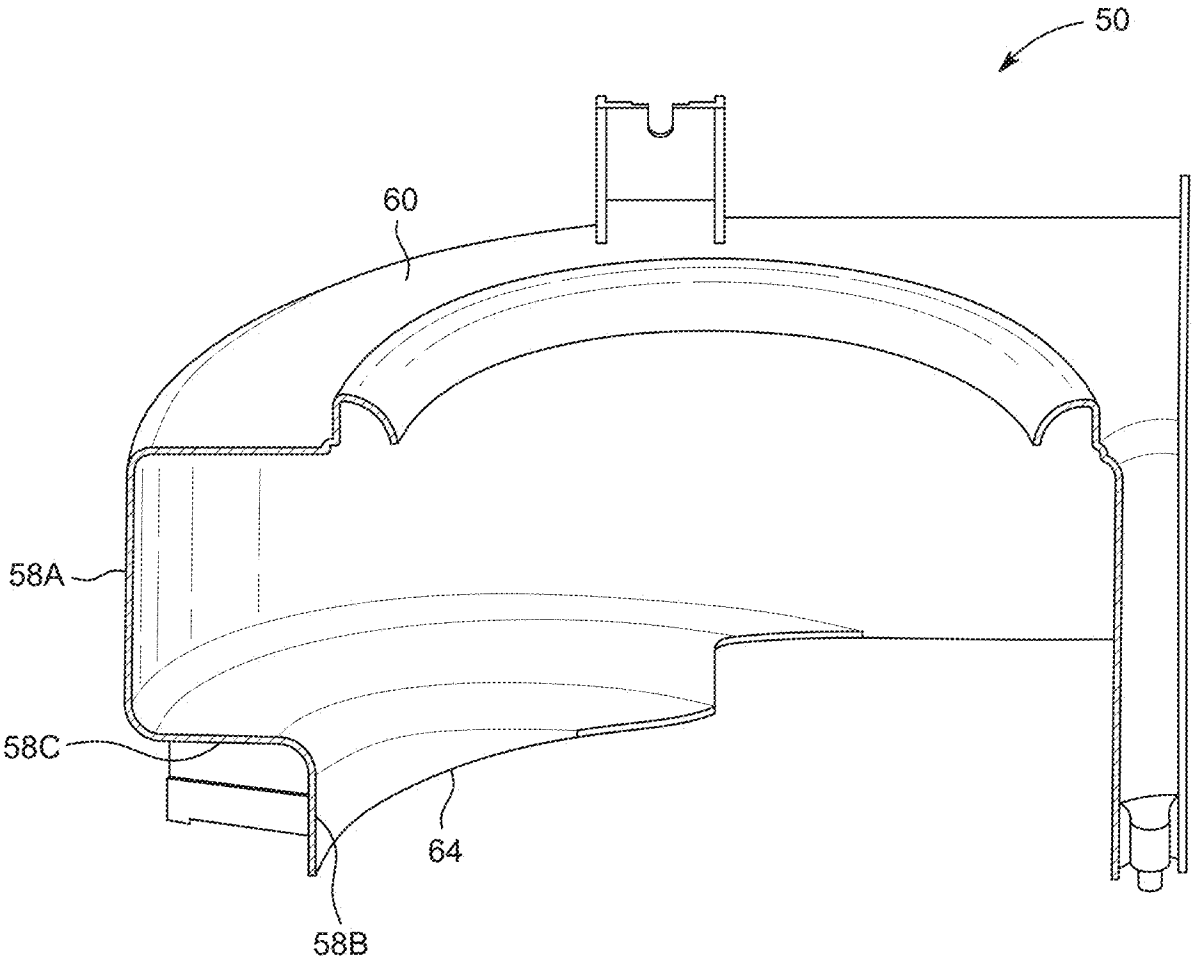
FIG. 5C is a top perspective view of the vertical cross-section depicted in FIG. 5B.
Figure 6A:
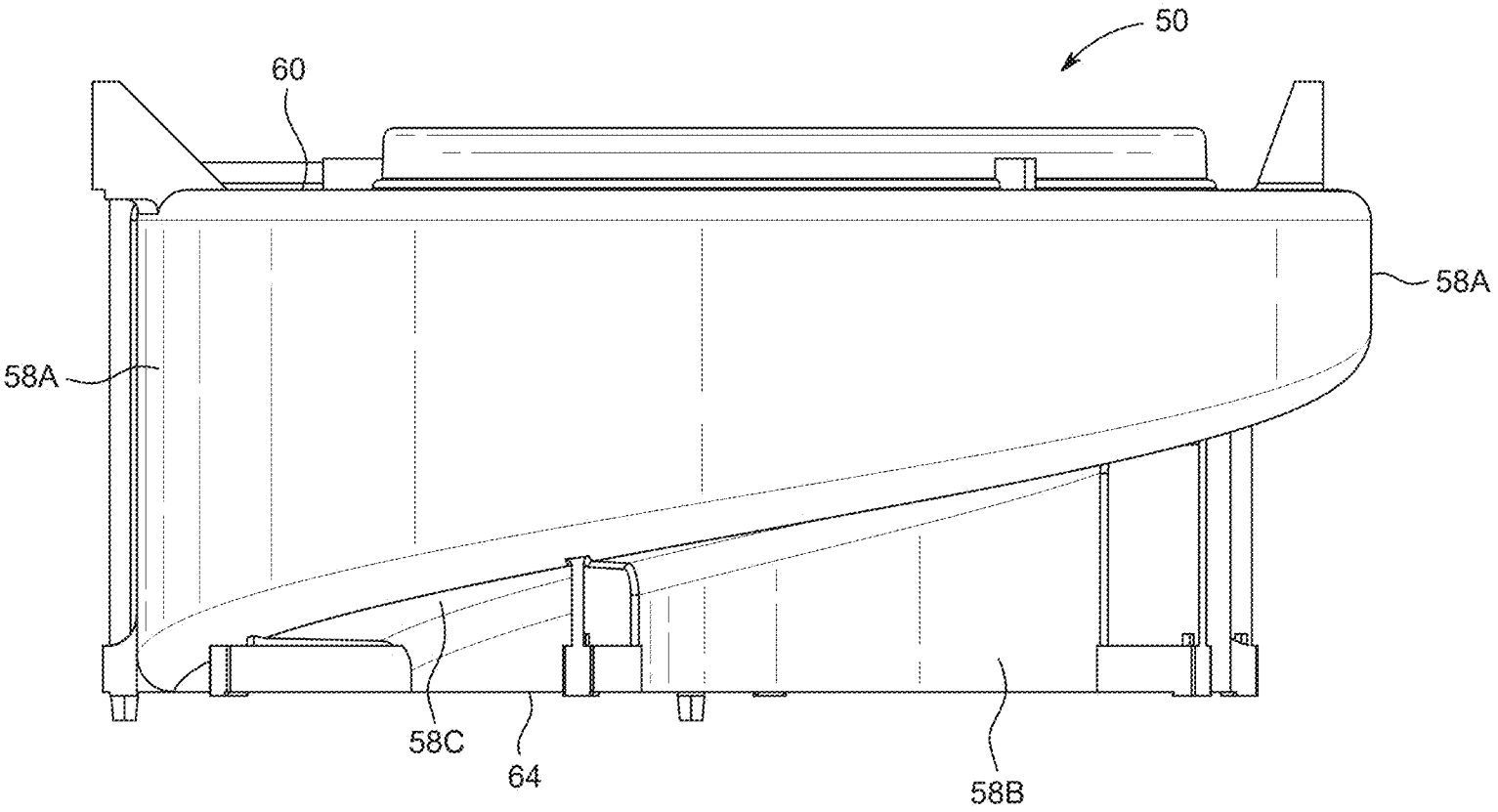
FIG. 6A is a rear plan view of the scroll of FIG. 1B.
Figure 6B:
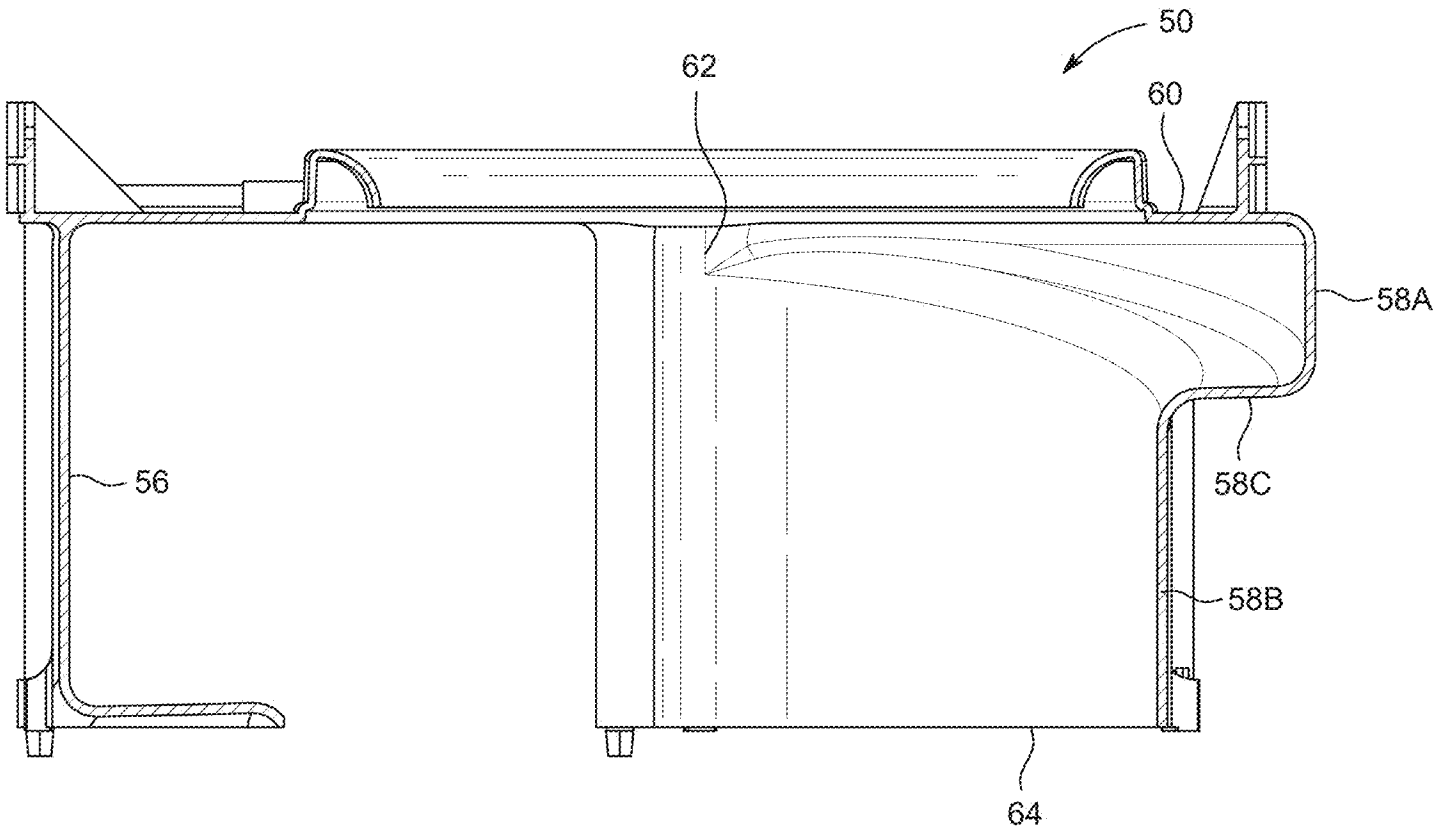
FIG. 6B is a vertical cross-section of the scroll as depicted in FIG. 6A.
Figure 6C:
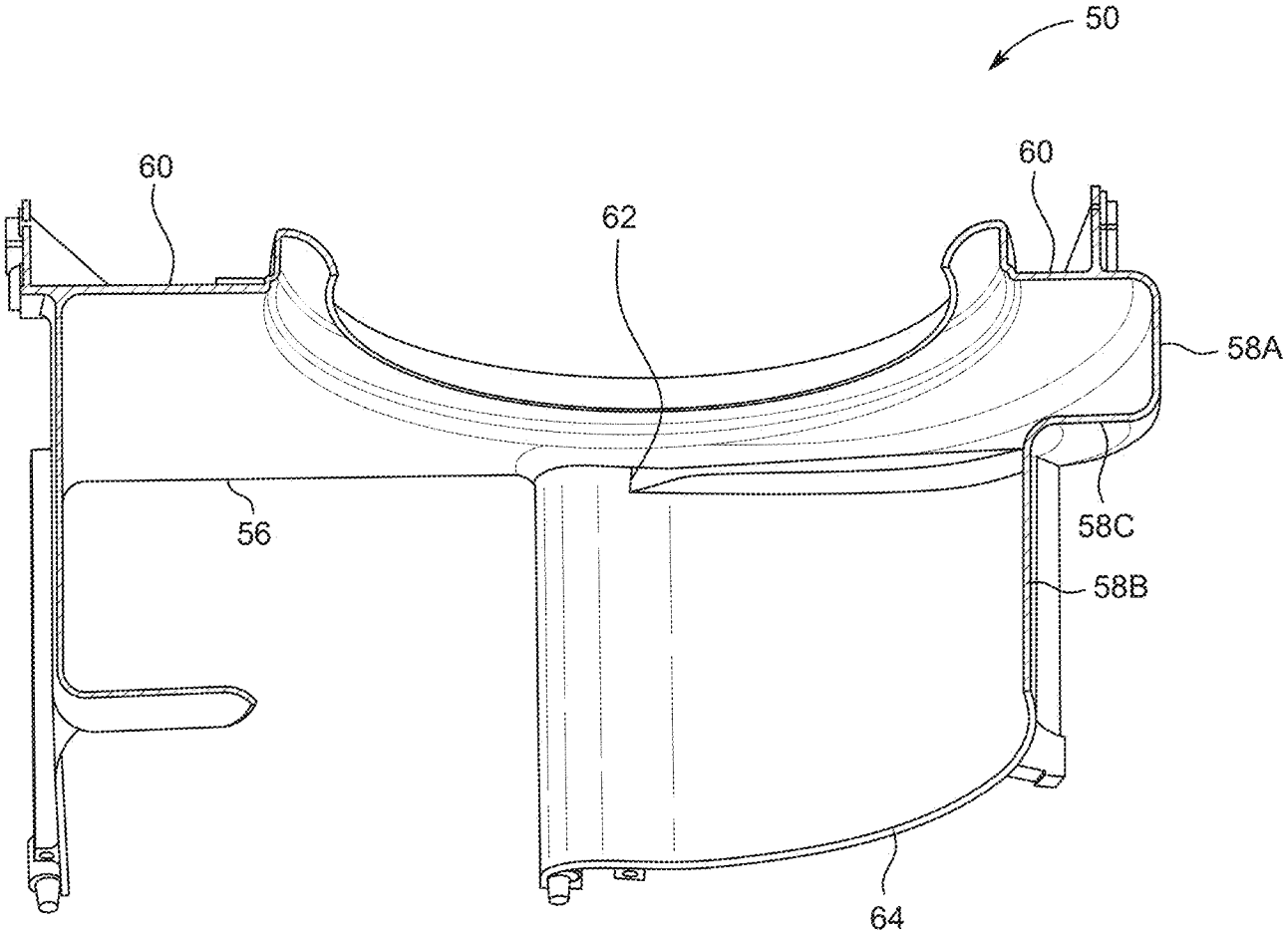
FIG. 6C is a bottom perspective view of the vertical cross-section depicted in FIG. 6B.

The configurations of the outer peripheral wall 58A, the transition wall 58C, the scroll top wall 60 and the location of the fan wheel outer edge 84 define an outer flow channel F1 (FIG. 2B) that expands both radially (according to the expansion angle) and vertically (according to the angle of decent) as it extends clockwise from the coincident point 62 around the peripheral wall 58 until reaching the inner peripheral wall terminal end 72. The configurations of the inner peripheral wall 58B and the location of the fan wheel outer edge 84 define an inner flow channel F2 (FIG. 2B) that remains constant in width (according to the size of gap G) and decreasing vertically in height (according to the angle of decent) from the coincident point 62 to the inner peripheral wall terminal end 72. The scroll 50 configuration the inner peripheral wall terminal end 72 to the scroll outlet 56 can take any known configuration and is preferably approximately constant to minimize the amount of turbulence introduced that air flowing between the inner peripheral wall terminal end 72 and the scroll outlet 56.

It has been found that locating the inner peripheral wall 58B close to the fan wheel outer edge 84 at a constant gap (i.e. gap G) reduces the amount of turbulence experienced when the fan wheel 80 is being rotated to move air through the scroll 50, as compared to traditional scrolls in which the entire peripheral wall follows an angle of expansion. The gap G can be sized as a percentage of the diameter of the fan wheel outer edge 84. In some embodiments, the gap G can be between 1% and 15% of the diameter of the fan wheel outer edge 84. In some embodiments, the gap G can be in the range of 0.25-0.5 inches.

It should be noted that the various components and features described above can be combined in a variety of ways, so as to provide other non-illustrated embodiments within the scope of the disclosure. As such, it is to be understood that the disclosure is not limited in its application to the details of construction and parts illustrated in the accompanying drawings and described hereinabove. The disclosure is capable of other embodiments and of being practiced in various ways. It is also to be understood that the phraseology or terminology used herein is for the purpose of description and not limitation.

Although the present disclosure has been described in the foregoing description by way of illustrative embodiments thereof, these embodiments can be modified at will, without departing from the spirit, scope, and nature of the subject disclosed.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. In addition, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

In one aspect, a term coupled or the like may refer to being directly coupled. In another aspect, a term coupled or the like may refer to being indirectly coupled. Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The use of the terms "a" and "an" and "the" and "said" and similar references in the context of describing the invention (especially in the context of the following claims) are to be construed to cover both the singular and the plural, unless otherwise indicated herein or clearly contradicted by context. An element proceeded by "a," "an," "the," or "said" does not, without further constraints, preclude the existence of additional same elements. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only, and should not be taken as limiting the scope of the disclosure.

The invention claimed is:

1. A ventilation fan comprising:

a fan housing having at least one outer wall defining an interior space, the fan housing defining an inlet and an outlet;

a scroll having an outer wall defining an interior space, an inlet opening into the interior space, and an outlet spaced apart from the inlet, wherein the scroll interior space is configured to house a fan wheel having an axis of rotation and capable of moving air from the scroll inlet to the scroll outlet, the scroll outer wall comprising an inner peripheral wall extending about the axis of rotation at a constant radius, wherein the inner peripheral wall defines a height which reduces about the axis of rotation according to an angle of descent; and an outer peripheral wall extending about the axis of rotation at a growing radius according to an expansion angle.

2. The ventilation fan of claim 1, the scroll further comprising a transition wall extending between the inner peripheral wall and the outer peripheral wall.

3. The ventilation fan of claim 1, wherein the inner peripheral wall is configured to be spaced a gap from the outer edge of the fan wheel.

4. The ventilation fan of claim 3, wherein the outer edge of the fan wheel defines a diameter and the size of the gap is between 1% and 15% of the fan wheel outer edge diameter.

5. The ventilation fan of claim 1, wherein the expansion angle is between 1 degree and 15 degrees.

6. A scroll for a ventilation fan, the scroll comprising:

an outer wall defining an interior space, an inlet opening into the interior space, and an outlet spaced apart from the inlet, wherein the scroll interior space is configured to house a fan wheel having an axis of rotation and capable of moving air from the scroll inlet to the scroll outlet, the scroll outer wall comprising an inner peripheral wall extending about the axis of rotation at a constant radius, wherein the inner peripheral wall defines a height which reduces about the axis of rotation according to an angle of descent; and an outer peripheral wall extending about the axis of rotation at a growing radius according to an expansion angle.

7. The scroll of claim 6, the scroll further comprising a transition wall extending between the inner peripheral wall and the outer peripheral wall.

8. The scroll of claim 6, wherein the inner peripheral wall is configured to be spaced a gap from the outer edge of the fan wheel.

9. The scroll of claim 8, wherein the outer edge of the fan wheel defines a diameter and the size of the gap is between 1% and 15% of the fan wheel outer edge diameter.

10. The scroll of claim 6, wherein the expansion angle is between 1 degree and 15 degrees.

11. A scroll for a ventilation fan, the scroll comprising:

an outer wall defining an interior space, an inlet opening into the interior space, and an outlet spaced apart from the inlet; and a fan wheel within the scroll interior space and defining an axis of rotation;

the scroll outer wall comprising an inner peripheral wall extending about the axis of rotation at a constant radius, wherein the inner peripheral wall defines a height which reduces about the axis of rotation according to an angle of descent; and an outer peripheral wall extending about the axis of rotation at a growing radius according to an expansion angle.

12. The scroll of claim 11, the scroll further comprising a transition wall extending between the inner peripheral wall and the outer peripheral wall.

13. The scroll of claim 11, wherein the inner peripheral wall is configured to be spaced a gap from the outer edge of the fan wheel.

14. The scroll of claim 13, wherein the outer edge of the fan wheel defines a diameter and the size of the gap is between 1% and 15% of the fan wheel outer edge diameter.

15. The scroll of claim 13, wherein the gap is between 0.25 inches and 0.5 inches.

16. The scroll of claim 11, wherein the expansion angle is between 1 degree and 15 degrees.

17. The scroll of claim 11, wherein the expansion angle is 6 degrees.

18. A scroll for a ventilation fan, the scroll comprising:

an outer wall defining an interior space, an inlet opening into the interior space, and an outlet spaced apart from the inlet, the outer wall comprising an inner peripheral wall and an outer peripheral wall;

a fan wheel within the scroll interior space and defining an axis of rotation;

an inner flow channel defined by the inner peripheral wall and an outer edge of the fan wheel, wherein the inner flow channel decreases in height around the axis of rotation;

an outer flow channel defined by the outer peripheral wall and the outer edge of the fan wheel, wherein the outer flow channel increases in height around the axis of rotation.

19. The scroll of claim 18, wherein the outer flow channel increases in width around the axis of rotation.

* * * * *